US005803822A

United States Patent [19]

Pursell

[11] Patent Number: 5,803,822

[45] Date of Patent: Sep. 8, 1998

[54] GOLF TRAINING AID

[76] Inventor: Kenneth Pursell, 1161 W. Norwood St., Rialto, Calif. 92377

[21] Appl. No.: 844,632

[22] Filed: Apr. 21, 1997

[51] Int. Cl.[6] ..... A63B 69/36

[52] U.S. Cl. ..... 473/216; 473/277

[58] Field of Search ..... 473/216, 277, 473/215

[56] References Cited

U.S. PATENT DOCUMENTS 4,593,909 6/1986 Anselmo et al. ..... 473/216

5,048,836 9/1991 Bellagamba ..... 473/216

5,308,074 5/1994 Dorotinsky ..... 473/216

*Primary Examiner*—George J. Marlo

*Attorney, Agent, or Firm*—Robert M. Sperry

[57] ABSTRACT

An improved golf training aid comprising a belt worn by the golfer having a pair of elastic straps which each have one end secured to the ground at locations spaced on opposite sides of the golfer and which extend about the golfer's waist and are releasably attached to the belt in a manner such that, as the golfer makes his swing, the straps will force his hips to rotate in a proper and timely manner to perform a smooth and coordinated swing.

6 Claims, 2 Drawing Sheets

GOLF TRAINING AID

FIELD OF INVENTION

This invention relates to the game of golf and is particularly directed to improved training aids for improving a golfer's swing.

PRIOR ART

It is well known that a proper swing is imperative to a good golf game. Unfortunately, most golfers have considerable difficulty in accomplishing a proper swing. One of the most common deficiencies is the failure to rotate one's hips in time with the arm swing to provide a proper follow-through. 1) Premature hip rotation can cause the club to hit the ball in a manner to cause a hook. 2) Similarly, late hip rotation can cause the ball to slice. 3) This is one of the most common faults which golfers encounter. 4) A properly timed hip rotation will cause the club face to strike the ball squarely, causing the ball to fly straight and adding considerable power and distance (clubhead speed) to the stroke. Numerous training aids devices have been proposed heretofore to correct improper hip rotation. Thus, for example, video cameras have been used to videotape the golfer during a practice session. The tape is then played back to enable the golfer to observe his error in the hope that he can then correct it. However, this technique is quite expensive. Also, seeing one's error does not provide the same learning benefit as properly performing the swing and observing how it feels. This benefit is not provided with the videotape technique. Other golf training aids have provided rigid stands which surround the golfer and into which the golfer would be strapped to force him to swing properly. However, such stands are bulky and uncomfortable and severely interfere with the golfer's natural swing. Consequently, they are of questionable help in training the golfer. Thus, none of the prior art golf training aids have been entirely satisfactory.

BRIEF SUMMARY AND OBJECTS OF INVENTION

These disadvantages of the prior art are overcome with the present invention and an improved golf training aid is provided which is simple and inexpensive to construct and purchase and is comfortable to wear and use, yet which forces the golfer to rotate his hips in a normal and proper manner and, hence, enables the golfer to feel a proper rotation and to learn to perform it.

The advantages of the present invention are preferably attained by providing an improved golf training aid comprising a belt worn by the golfer having a pair of elastic straps which each have one end secured to the ground at locations spaced on opposite sides of the golfer and which extend about the golfer's waist and are releasably attached to the belt in a manner such that, as the golfer makes his swing, the straps will force his hips to rotate in a proper and timely manner to perform a smooth and coordinated swing.

Accordingly, it is an object of the present invention to provide an improved golf training aid.

Another object of the present invention is to provide an improved golf training aid for improving a golfer's swing.

An additional object of the present invention is to provide an improved golf training aid for improving a golfer's hip rotation during his swing.

A further object of the present invention is to provide an improved golf training aid which is simple and inexpensive to construct and purchase.

Another object of the present invention is to provide an improved golf training aid which is comfortable to wear and use.

An additional object of the present invention is to provide an improved golf training aid which forces the golfer to rotate his hips in a normal and proper manner and, hence, enables the golfer to feel a proper rotation and to learn to perform it.

A specific object of the present invention is to provide an improved golf training aid comprising a belt worn by the golfer having a pair of elastic straps which each have one end secured to the ground at locations spaced on opposite sides of the golfer and which extend about the golfer's hips and are releasably attached to the belt in a manner such that, as the golfer makes his swing, the straps will force his waist to rotate in a proper and timely manner to perform a smooth and coordinated swing.

These and other objects and features of the present invention will be apparent from the following detailed description, taken with reference to the figures of the accompanying drawing.

BRIEF DESCRIPTION OF THE DRAWING

FIG. 5 is a view, similar to that of FIG. 2, showing the golfer at the end of the follow-through.

DETAILED DESCRIPTION OF THE INVENTION

Figure 1:
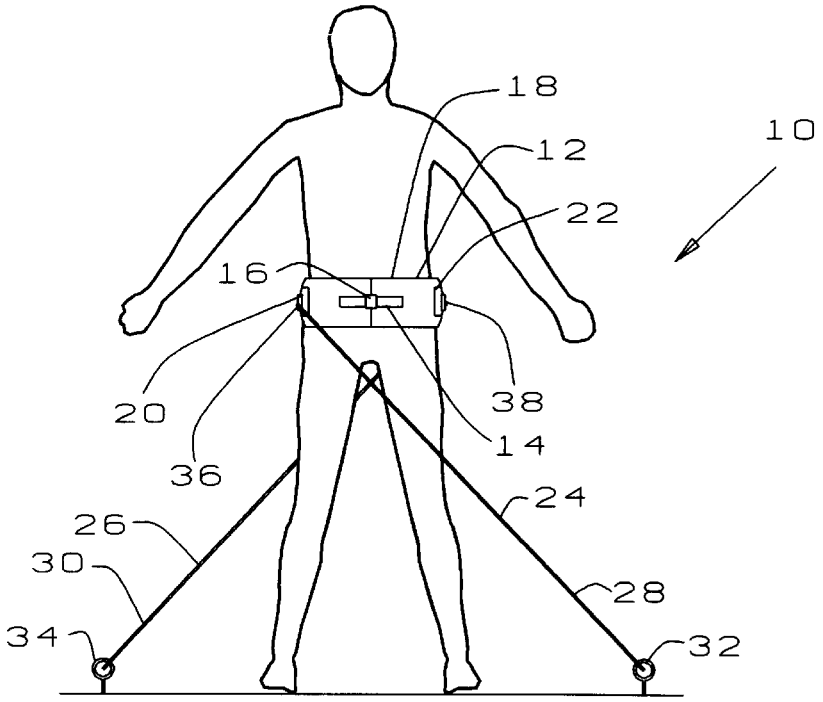
FIG. 1 is a front view of a golfer wearing a golf training aid embodying the present invention.
Figure 2:
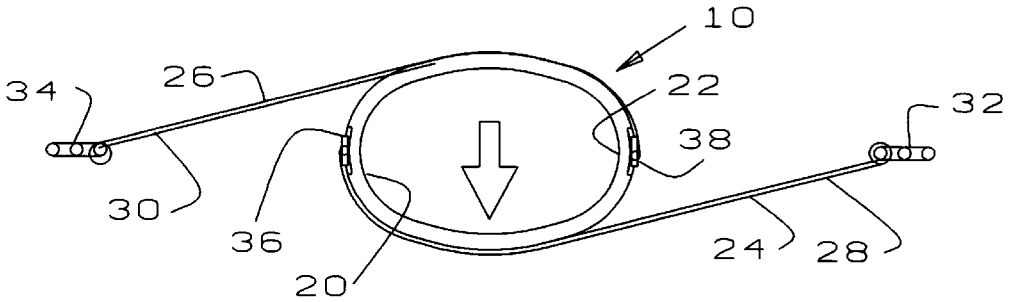
FIG. 2 is a plan view of the golfer of FIG. 1, shown in the neutral or ball-addressing position.

In that form of the present invention chosen for purposes of illustration, FIG. 1 shows a golfer, indicated generally at 10, wearing a belt 12 which is secured about the golfer 10 by releasable attaching means, such as strap 14 and buckle 16. The outer surface 18 of the belt 12 carries releasable fastening means 20 and 22, such as patches of hook-and-loop material, mounted on opposite sides of the belt 12, as seen in FIG. 2. A pair of elastic bands 24 and 26 each have one end 28 and 30, respectively, secured to suitable ground attaching means 32 and 34, such as eyescrews, while the opposite ends of the bands 24 and 26 carry releasable fastening means 36 and 38, respectively, which are releasably attached to a respective one of the releasable fastening means 20 or 22.

Figure 3:
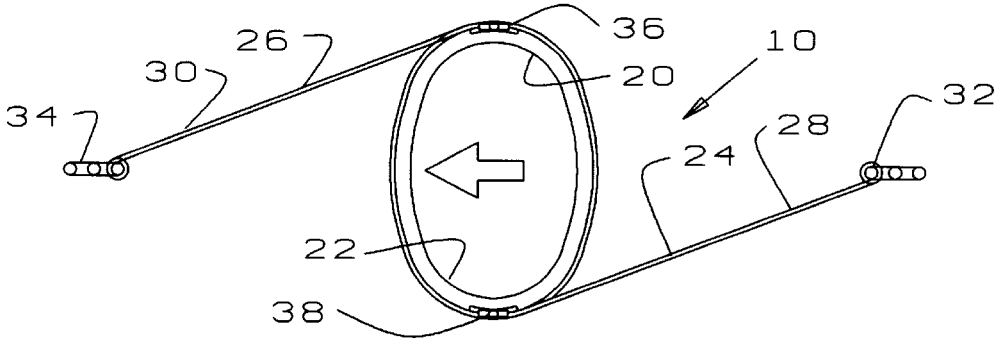
FIG. 3 is a view, similar to that of FIG. 2, showing the golfer at the top of the backswing.
Figure 4:
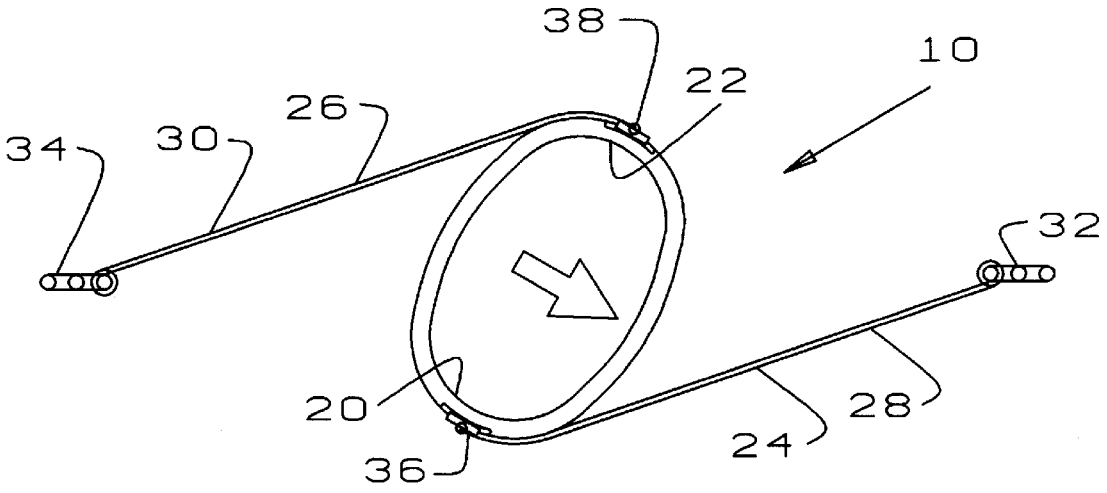
FIG. 4 is a view, similar to that of FIG. 2, showing the golfer at the impact position.
Figure 5:
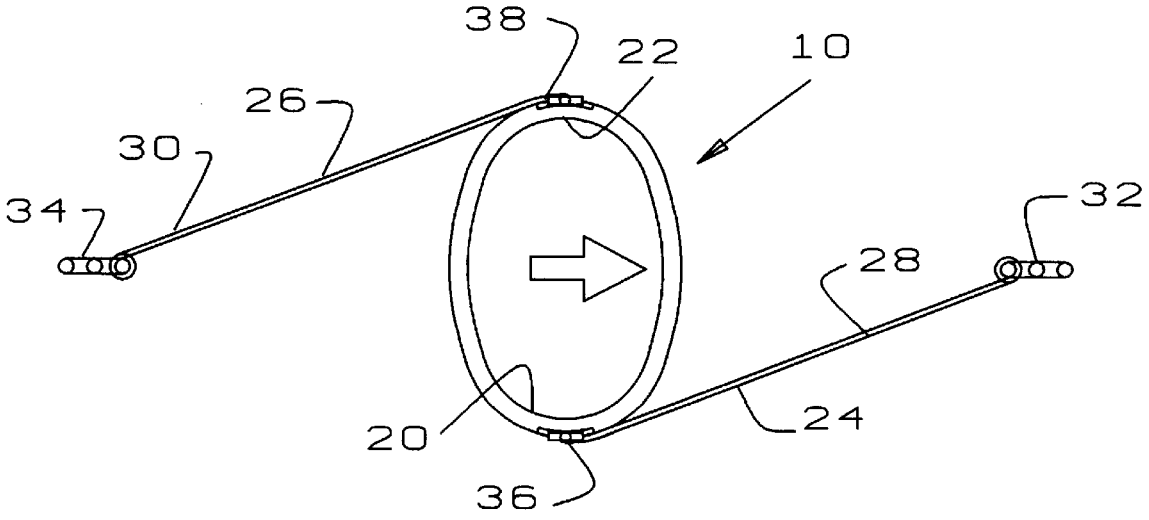

In use, the golfer 10 secures the ground attaching means 32 and 34 at appropriate distances on opposite sides of the location where he will practice his swing and attaches ends 28 and 30 of the elastic bands 24 and 26 with his hips in the ball-addressing position, as seen in FIGS. 1 and 2. The golfer 10 then twists his hips to the follow-through position, seen in FIG. 5, and attaches releasable fastening device 36 of elastic band 24 to the releasable fastening means 20 on the right side of belt 12. Next, the golfer 10 attaches releasable fastening device 38 of elastic band 26 to the releasable fastening means 22 on the left side of belt 12. After this, the golfer 10 rotates his hips to the neutral or ball-addressing position, as seen in FIGS. 1 and 2. He is now ready to plan his swing. When the golfer 10 begins his swing, he rotates his hips to the right to make his backswing, which places considerable tension on the elastic bands 24 and 26, as seen in FIG. 3. As the golfer 10 makes his swing, he can concentrate on the motion of the club, while elastic bands 24 and 26 will automatically cause his hips to rotate through the neutral position of FIG. 2 and the impact position, as seen in FIG. 4, and will continue to pull throughout the entire stroke and will urge the golfer's hips to the follow-through position of FIG. 5. After a few swings, the golfer 10 will recognize the feeling of proper hip roration and will be able to accomplish this motion without the assistance of the elastic bands 24 and 26. The training aid is intended for use at a driving range or in the back yard, without interfering with the golfer's swing and serves to promote muscle memory of the proper rotation.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A golf training aid attached between a golfer and the ground to cause proper rotation of the golfer's hips during a stroke, said golfing aid comprising:

a belt worn by a golfer, a pair of ground attaching means located on opposite sides of the golfer, and a pair of elastic bands each having one end connected to a respective right or left side of said belt and having the other end connected to the ground attaching means on the remote side of said golfer.

2. The training aid of claim 1 wherein:

one of said elastic bands is attached to the right side of said belt and extends around the golfer to the ground attaching means on the golfer's left, while the other of said bands is attached to the left side of said belt and extends around the golfer to the ground attaching means on the golfer's right.

3. The training aid of claim 1 wherein:

said belt carries releasable fastening means secured to opposite sides of the golfer.

4. The training aid of claim 1 wherein:

said belt carries patches of hook-and-loop material mounted on opposite sides of said belt and said one end of each of said elastic bands carries releassable fastening means engageable with said patches.

5. The training aid of claim 1 wherein:

said ground attaching means are eyescrews.

6. A golf training aid attached between a golfer and the ground to cause proper rotation of the golfer's hips during a stroke, said golfing aid comprising:

a belt worn by the golfer having releasable fastening means mounted on opposites sides of said belt, a pair of ground attaching means located on respective sides of the golfer, a pair of elastic straps each having one end secured to a respective one of said ground attaching means, and means releasably attaching one of said elastic bands from the ground attaching means on the golfer's left in front of the golfer to the releasable fastening means on the right side of said belt and attaching the other of said elastic bands from the ground attaching means on the golfer's right behind the golfer to the releasable fastening means on the left side of said belt.

* * * * *